US006168340B1

(12) United States Patent
Lehmann et al.

(10) Patent No.: US 6,168,340 B1
(45) Date of Patent: Jan. 2, 2001

(54) PORTFOLIO HAVING MULTIPLE POCKETS

(75) Inventors: Lora Lehmann, Kenosha, WI (US); Fred Edward Cecala, Mt. Prospect; Michael Joseph Anguiano, Evanston, both of IL (US); Paul Rossetto, Oak Creek, WI (US)

(73) Assignee: ACCO Brands, Inc., Lincolnshire, IL (US)

( * ) Notice: Under 35 U.S.C. 154(b), the term of this patent shall be extended for 0 days.

(21) Appl. No.: 09/396,790

(22) Filed: Sep. 15, 1999

(51) Int. Cl.[7] ..... B42F 3/00
(52) U.S. Cl. ..... 402/79; 281/38; 281/45
(58) Field of Search ..... 281/15.1, 21.1, 281/22, 29, 31, 37, 38, 51, 45; 402/70, 73, 79, 4; 353/120

(56) References Cited

U.S. PATENT DOCUMENTS

| | | | | |
|---|---|---|---|---|
| D. 314,977 | | 2/1991 | Wyant | D19/27 |
| 748,631 | | 1/1904 | Mitchell . | |
| 3,680,969 | | 8/1972 | Gorman | 402/3 |
| 4,128,262 | | 12/1978 | Du Corday | 281/34 |
| 4,172,332 | | 10/1979 | Holes et al. | 40/159 |
| 4,350,195 | | 9/1982 | Viesturs et al. | 150/39 |
| 4,639,157 | | 1/1987 | Herzfeld | 402/19 |
| 4,925,720 | | 5/1990 | Hansen | 428/77 |
| 4,962,951 | | 10/1990 | Mechesney | 283/114 |
| 5,114,009 | | 5/1992 | Johnston | 206/425 |
| 5,236,226 | | 8/1993 | Sheffield | 281/48 |
| 5,266,987 | | 11/1993 | Kiehne et al. | 353/120 |
| 5,319,400 | | 6/1994 | Herbert et al. | 353/120 |
| 5,335,027 | | 8/1994 | Lin et al. | 353/120 |
| 5,417,509 | * | 5/1995 | Schwartz | 402/79 |
| 5,711,627 | * | 1/1998 | Chapman | 281/31 X |
| 5,713,684 | | 2/1998 | Turecamo | 402/79 |
| 5,722,694 | * | 3/1998 | Baldursson | 281/38 X |
| 5,795,089 | * | 8/1998 | Ong | 281/38 X |
| 5,806,677 | | 9/1998 | Storti | 206/425 |
| 5,888,011 | * | 3/1999 | Reinbold, Jr. | 402/79 X |
| 6,019,539 | * | 2/2000 | Lynton | 281/38 X |

* cited by examiner

*Primary Examiner*—Willmon Fridie, Jr.
(74) *Attorney, Agent, or Firm*—Pennie & Edmonds LLP

(57) ABSTRACT

A portfolio for holding items such as sheets of paper is constructed a single sheet of translucent material having a scored line to act as a hinge and divided the material into front and back covers. The portfolio is provided with at least three pockets constructed of transparent material welded onto the portfolio. Two of the pockets are provided on the interior of the front and back covers for retaining sheets of paper, and a third pocket is provided on the exterior surface of the front cover for holding a sheet of material such as a cover label. The pockets may be provided with cutouts to allow expansion of the pockets and stress relief structures to prevent tearing of the pockets upon repeated insertion and removal of items from the pockets. The portfolio also includes a plurality of holes for attachment in a ringed binder and slits running from the holes to the hinge to permit insertion of the portfolio into the binder without opening the rings.

20 Claims, 7 Drawing Sheets

PORTFOLIO HAVING MULTIPLE POCKETS

TECHNICAL FIELD

The present invention relates to portfolios capable of insertion into three-ringed binders and having interior and exterior pockets for retaining sheets of paper.

BACKGROUND

Portfolios have been provided with various arrangements of pocket to hold sheets of paper. Generally, these portfolios have front and back covers that are hinged together, and the pockets are disposed on the covers. Papers from a presentation and or seminar are placed in the pockets. Insertion and removal of paper from the pockets can cause the pockets to wear or tear. Some pockets cannot accommodate large amounts of paper. In addition, the printing from the papers can transfer to certain types of portfolio material.

The need exists for a portfolio constructed of a material to which print does not transfer that has multiple pockets that can accommodate relatively large amounts of paper, can hold paper securely, are not susceptible to tearing upon insertion and removal of the paper, and can be placed in larger binders to keep the papers from different but related presentations or seminars together.

SUMMARY OF THE INVENTION

According to the present invention, a portfolio having multiple transparent pockets is provided that can hold sheets of paper and that can be stored in a binder having fasteners such as a three-ringed type binder. The portfolio is constructed from a single sheet of translucent or opaque, colored material. A scored line divides the sheet of material into front and back covers and serves as a hinge about which the covers can pivot with respect to each other between an open and a closed position. The portfolio is provided with at least three pockets constructed of transparent material heat sealed onto the front and back covers.

Two of the pockets are preferably identical and are provided in a vertical orientation on the interior of the front and back covers for retaining sheets of paper, and a third pocket is provided on the exterior surface of the front cover for holding a sheet of material such as a cover label. The third pocket also has a vertical orientation, and paper is placed in the overlay pocket by sliding it under the overlay material from an edge adjacent to the portfolio hinge. The pockets may be provided with cutouts to allow expansion of the pockets and stress relief structures to prevent tearing of the pocket openings upon repeated insertion and removal of items from the pockets. The portfolio also includes a plurality of holes for attachment in a ringed binder and slits running from the holes to the hinge to permit insertion of the portfolio into the binder without opening the rings.

DETAILED DESCRIPTION OF A PREFERRED EMBODIMENT

Figure 1:
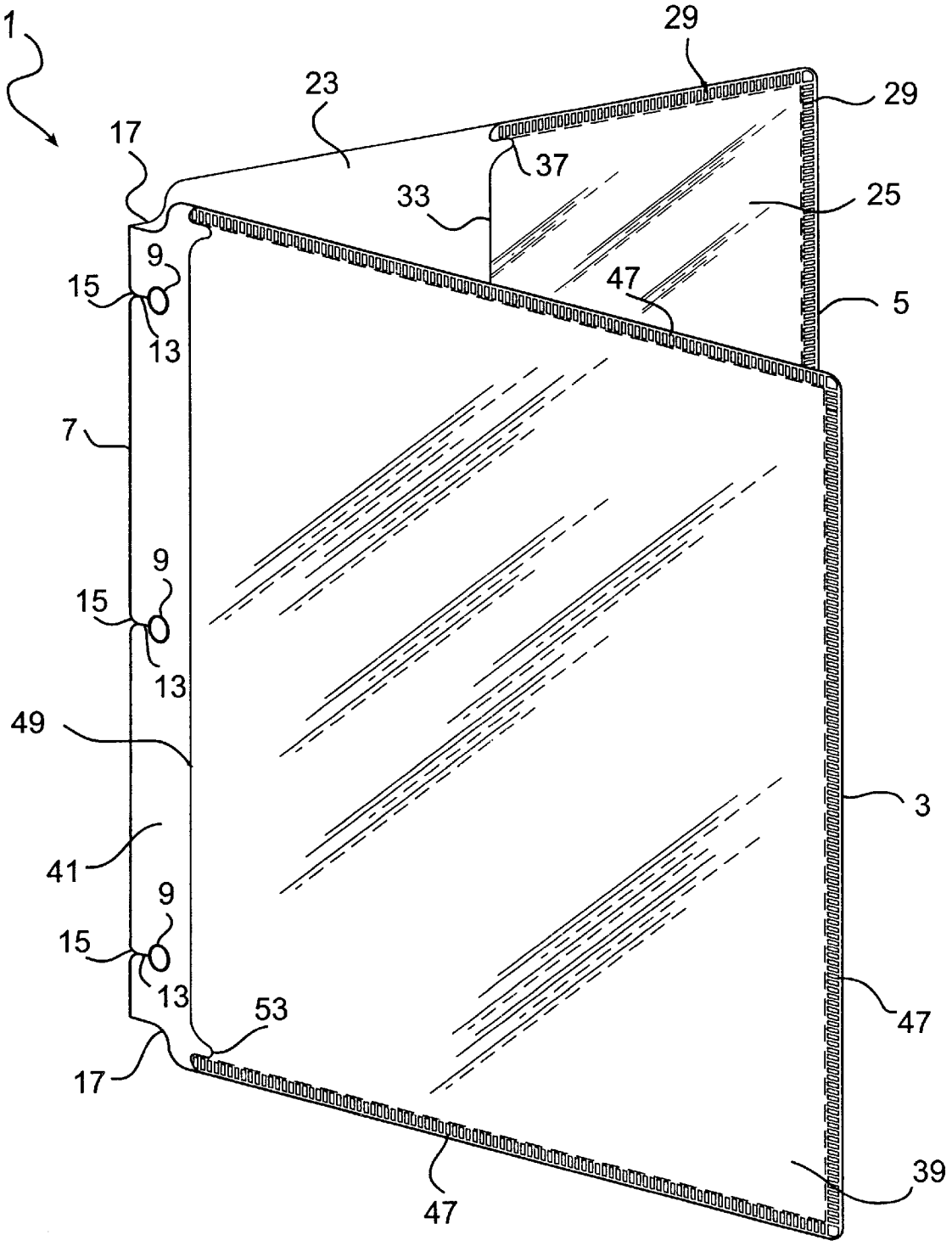
FIG. 1 is a perspective view of the portfolio according to the present invention.
Figure 2:
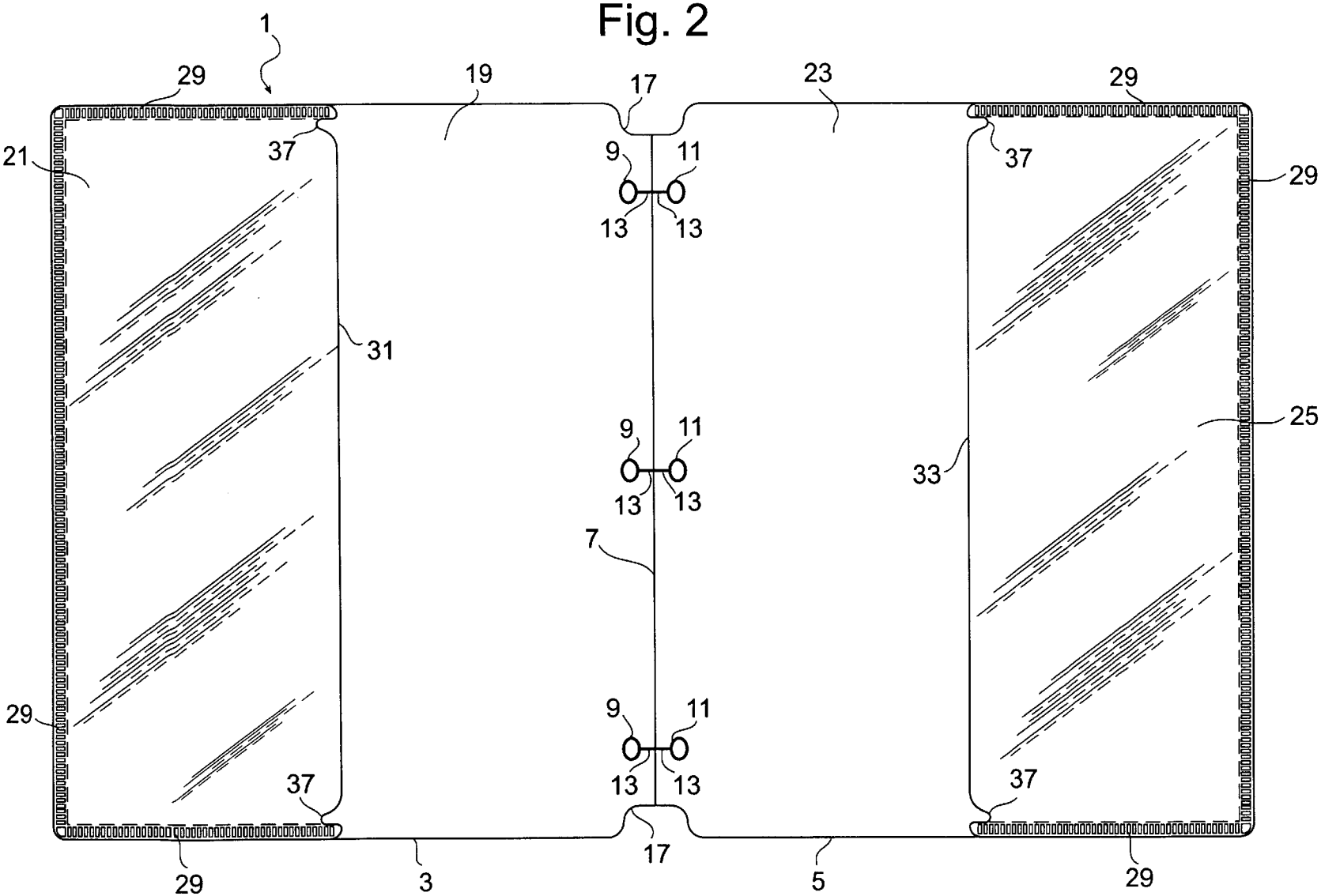
FIG. 2 is an interior plan view of an embodiment of the portfolio of the present invention in an open position.
Figure 3:
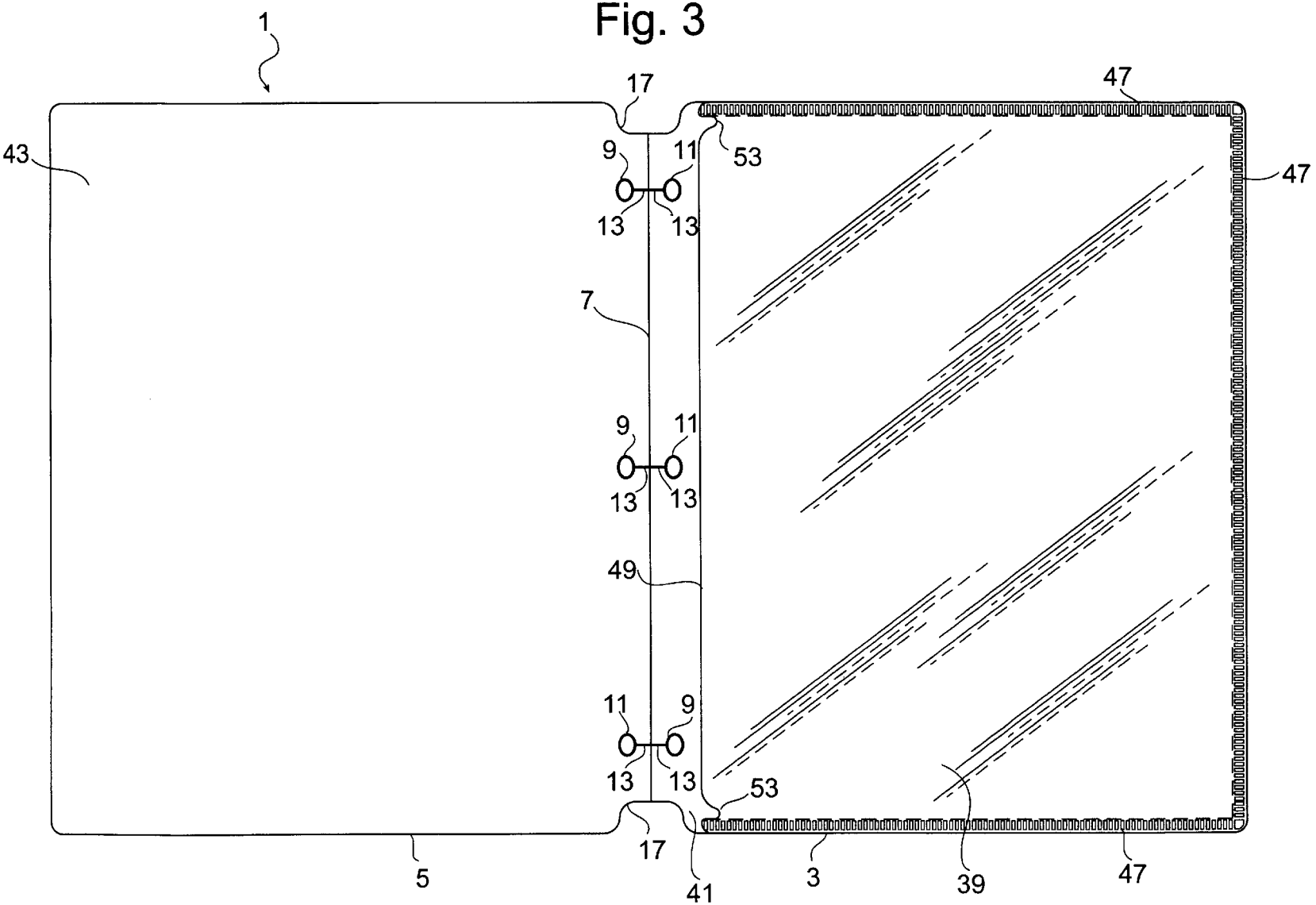
FIG. 3 is an exterior plan view of an embodiment of the portfolio of the present invention in an open position.

Referring initially to FIGS. 1–3, the portfolio 1 of the present invention includes a front cover 3 and a back cover 5. The front and back covers are pivotally attached to each other along a hinge 7 so that the covers may pivot or rotate about the hinge 7 with respect to one another between an open position as shown in FIGS. 2 and 3 and a closed position when the front and back covers come into contact. The hinge 7 can be a single hinge such as a piano-type hinge or a plurality of discrete hinges and can either be formed integral with the front and back covers or constructed of separate parts that are attached to the covers. Preferably, the front and back covers are constructed from a single sheet of material, and the hinge 7 is formed from a scored line that is made between the front and back covers. Suitable materials for the covers include paper, cardboard, and plastics either opaque, translucent, or transparent. The covers may be white, black, or colored. Preferably, the covers are made of translucent polypropylene. Polypropylene is preferred because the writing from paper will not transfer to the polypropylene.

The portfolio may include structures that enable it to be inserted, secured, and removed from binders having fasteners, such as three-ringed type binders. Therefore, the font and back covers are sized to accommodate the size of the papers to held and the structures for insertion into a binder. Suitable structures include a plurality of front cover holes 9 disposed in and passing through the front cover 3 and arranged to accommodate the fastener pattern inside the binder. Likewise, a plurality of back cover holes 11 are disposed in and pass through the back cover 5 and are arranged to align with the front cover holes 9 when the portfolio 1 is in the closed position. The front and back cover holes may also be arranged in a universal pattern to accommodate any one of a number of binder fastener patterns. Further, the holes may be either circular, rectangular, or elongated such a ellipses or slots.

Figure 4:
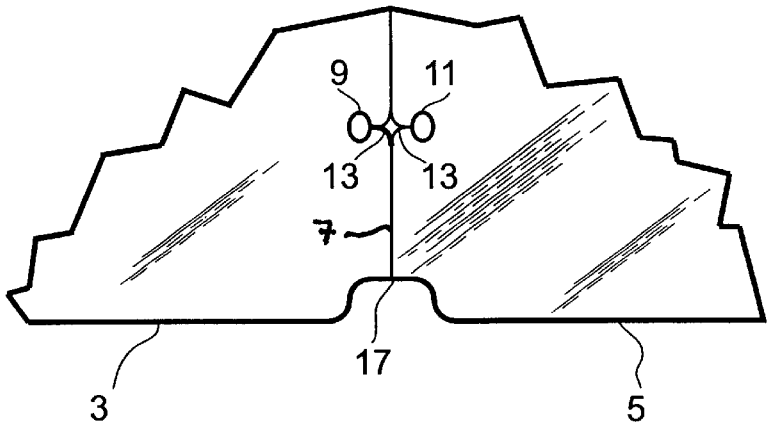
FIG. 4 is a partial exploded view of the holes in the portfolio of the present invention.
Figure 5:
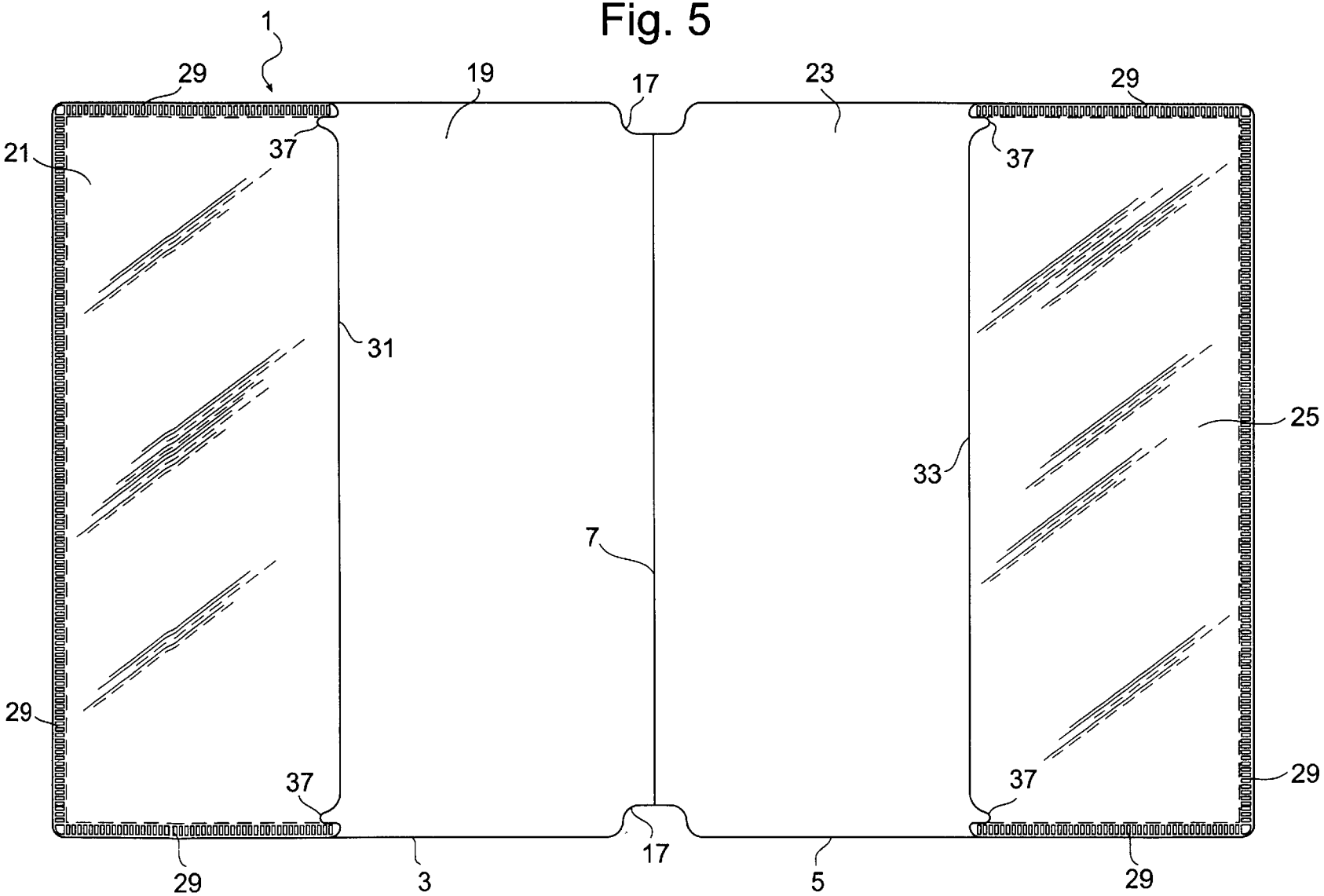
FIG. 5 is an interior plan view of another embodiment of the portfolio of the present invention in an open position.

As is best shown in FIG. 4, a plurality of slits 13 are provided in the front and back covers running from the hinge 7 to each one of the plurality of front and back cover holes. These slits 13 permit the insertion and removal of the portfolio 1 from a binder and the engagement of the binder fasteners with the cover holes without having to open or release the binder fasteners. Removal and insertion of the portfolio 1 may be aided by the provision of flared ends 15 of the slits; however, as is shown in FIGS. 2 and 3, the slits 13 can be provided without flared ends 15 and still permit the rapid insertion and removal of the portfolio 1 from a binder. To further accommodate the fastener mechanisms inside of a binder and in particular the levers used to operate the rings in a ring-type binder, a notch 17 is provided in the portfolio 1 on either end of the hinge 7. As is shown in FIG. 5, the portfolio 1 may alternatively be provided without the plurality of front and back cover holes.

Pockets are provided in the portfolio 1 for securing items such as sheets of paper in the portfolio. Any arrangement and number of pockets may be provided in the portfolio 1. Preferably, the front cover interior surface 21 includes at least one front cover pocket 23, and the back cover interior surface 25 includes at least one back cover pocket 27. The front cover pocket 21 is formed from a first sheet of material, and the back cover pocket 25 is formed from a second sheet of material. The first and second sheets of material may be circular, triangular, rectangular, or square and may be made from opaque, translucent, or transparent material. The first and second sheets of material may be any size up to the size of the front and back cover interiors. A plurality of front and back cover pockets may also be provided and can be arranged to overlap either entirely or partially or may be completely independent of one another.

Figure 6:
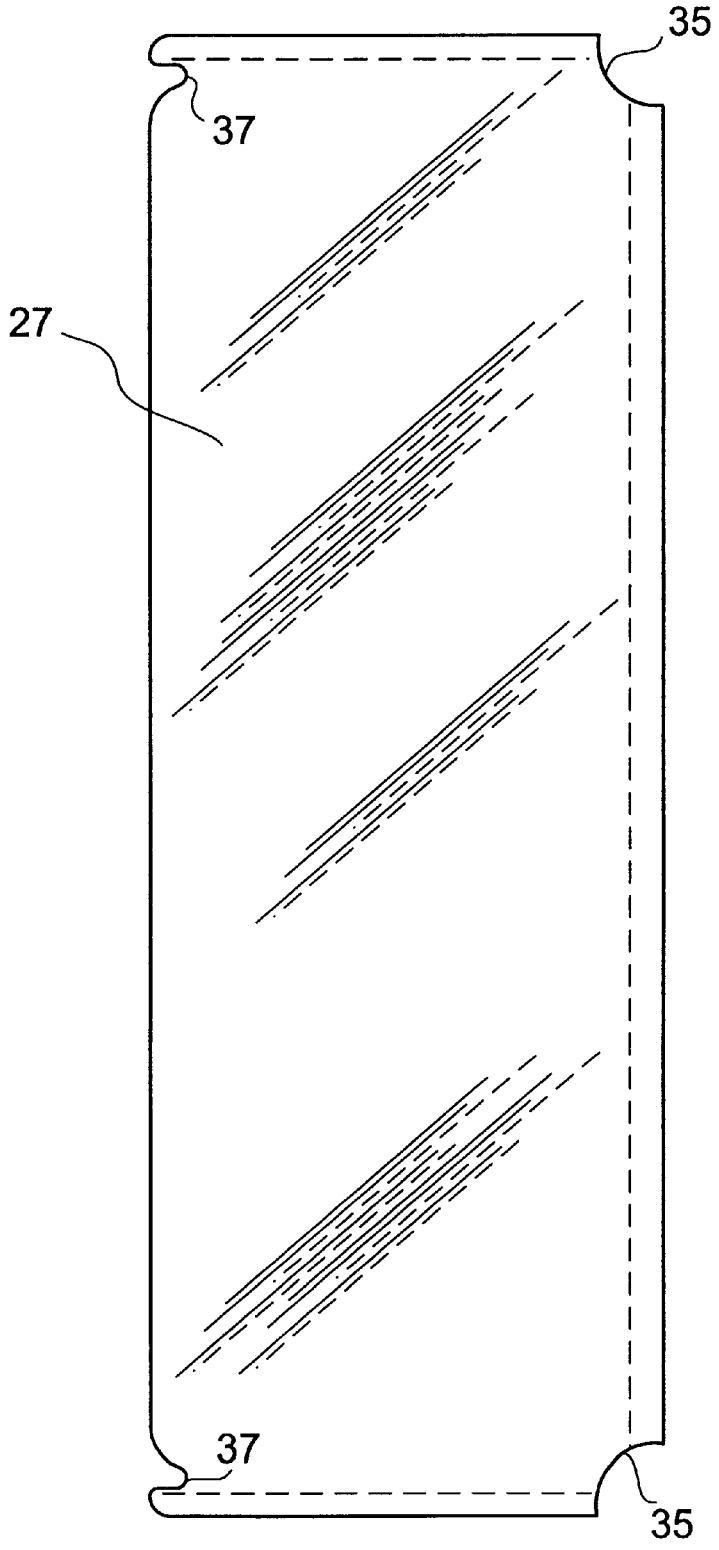
FIG. 6 is a transparent sheet of material for the interior pockets in the portfolio of the present invention.

As is illustrated in FIG. 6, the first and second sheets of material are preferably made of a rectangular sheet of transparent plastic 27. The rectangular sheet of transparent plastic 27 can be any size up to the size of the front or back cover interior surface. The overlay pocket may cover only a portion of the front or back cover and may be attached to the cover interior surfaces themselves or one or all of the cover edges. Preferably, the rectangular sheet of transparent plastic 27 only covers a portion of the front or back cover interior surface. However, the rectangular sheet of transparent plastic 27 should be of sufficient size to secure items such as sheets of paper into the portfolio and to provide for the attachment of the sheet to the front and back covers. Such attachment can be accomplished by any conventional means including as staples, adhesives, ultrasonic welds, or heat. Preferably, the rectangular sheet of transparent plastic 27 is attached to the front or back cover interior surface by a plurality of discrete welds 29 running along three sides of the sheet 27. The fourth side is not attached to the front or back cover and forms a front cover pocket opening 31 and a back cover pocket opening 33. The fourth side may extend any distance across the cover from a length just far enough to hold the sheets of paper up to the width of the paper itself. Preferably, the front and back cover pocket openings are parallel to the hinge 7. This arrangement of the pockets holds the inserted papers in the portfolio more securely.

Figure 7:
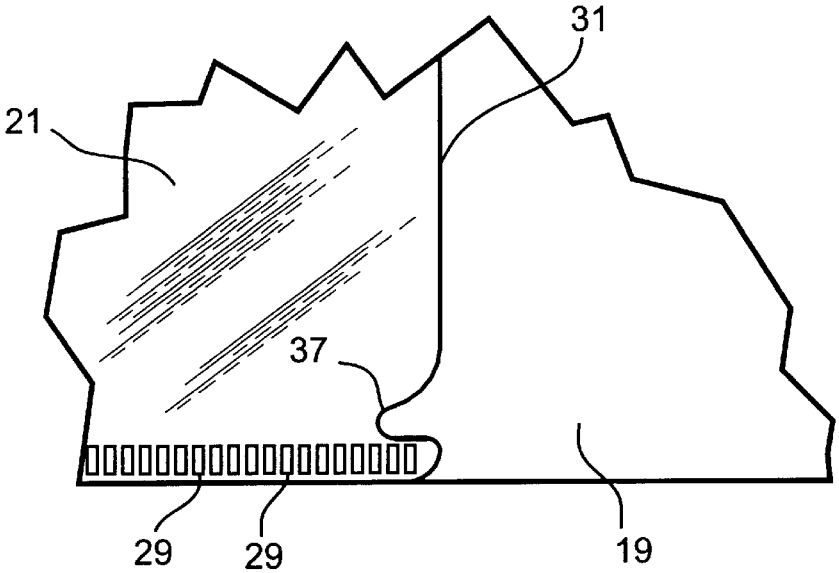
FIG. 7 is an exploded view of the stress relief structure of the interior pockets.

Since items of varying size and varying amounts of paper may be inserted into the front and back cover pockets, cutouts 35 are provided in the rectangular sheet of transparent plastic 27 to permit expansion of the pockets. As shown in FIG. 6, preferably two cutouts 35 are provided for each sheet of pocket material. The cutouts 35 are preferably circular in shape and disposed at the intersection of the three sides that are attached to the front and back covers. In order to prevent the sheet of material 27 and hence the front and back cover pockets from tearing upon repeated insertion and removal of items, a stress relief structure 37 is provided on either end of the front cover pocket opening 31 and the back cover pocket opening 33. As is best shown in FIG. 7, the stress relief structure 37 is generally curved in shaped with varying radii of curvatures. The stress relief structure 37 permits the opening 31 to flex to accommodate the insertion of items into the pocket while leaving the pocket welds 29 unaffected.

In order to hold additional items, sheets of paper, or a label for the portfolio 1, at least one overlay pocket 39 may be provided on either the front cover exterior surface 41 or the back cover exterior surface 43. However, the present invention covers portfolios that do not have any exterior or overlay pockets, but instead only include a plurality of interior pockets. Although a plurality of overlay pockets may be provided on either one or both of the cover exteriors, preferably, one overlay pocket 39 is provided on the front cover exterior surface 39. The overlay pocket 39 is formed from a third sheet of material. The third sheet of material may be circular, triangular, rectangular, or square and may be made from opaque, translucent, or transparent material. The third sheet of material may be any size up to the size of the front cover. A plurality of front and back cover overlay pockets may also be provided and can be arranged to overlap either entirely or partially or may be completely independent of one another.

Figure 8:
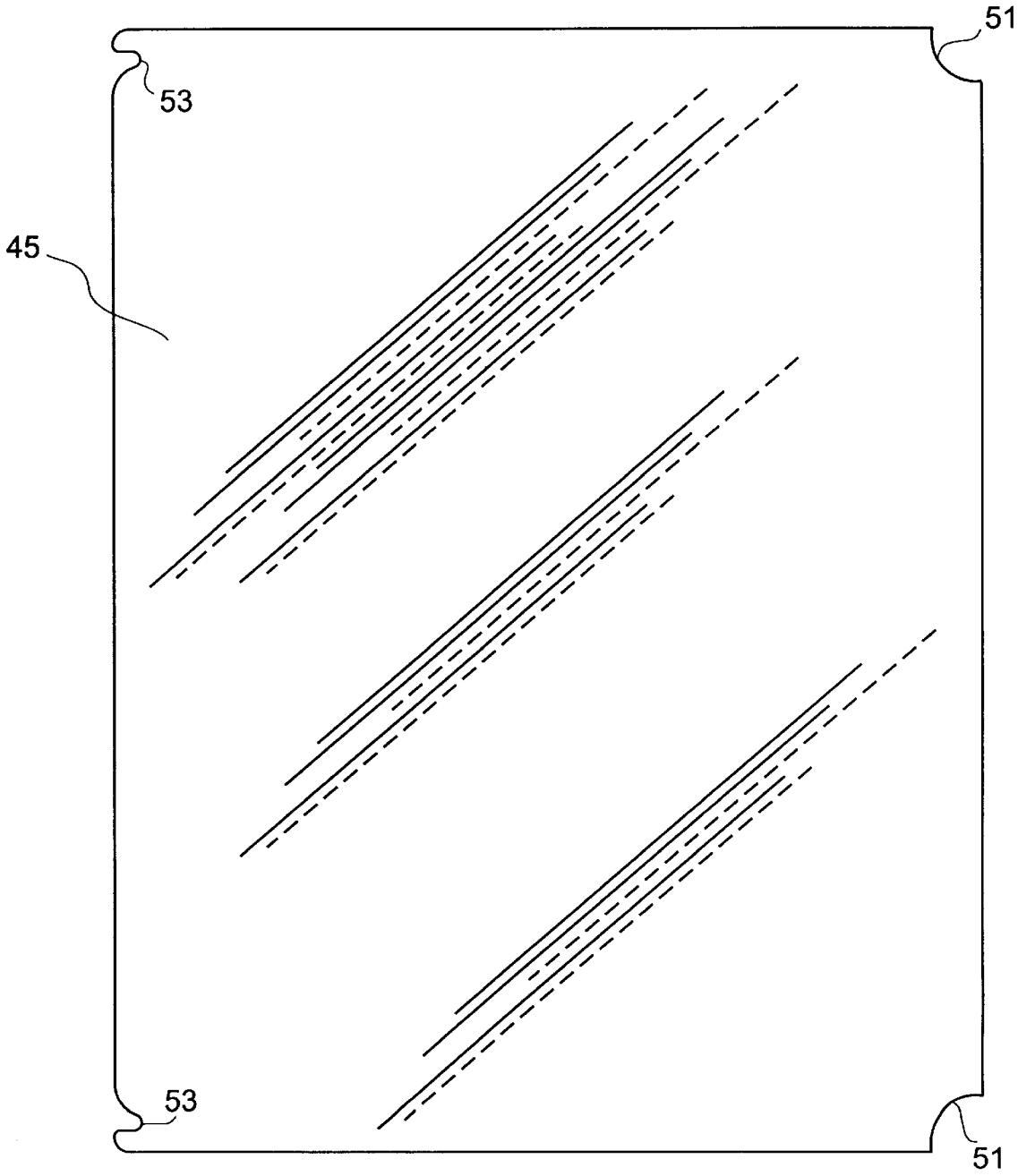
FIG. 8 is a transparent sheet of material for the exterior overlay pocket of the portfolio of the present invention.

As is illustrated in FIG. 8, the third sheet of material is preferably made of a rectangular sheet of transparent plastic 45. The rectangular sheet of transparent plastic 45 can be any size up to the size of the front or back cover exterior surface. Preferably, the rectangular sheet of transparent plastic 45 is sized to completely cover a sheet of inserted into the pocket and to provide for the attachment of the sheet to the front and back covers. Such attachment can be accomplished by any conventional means including staples, adhesives, ultrasonic welds, or heat. Preferably, the rectangular sheet of transparent plastic 45 is attached to the front or back cover interior surface by a plurality of discrete welds 47 running along three sides of the sheet 45. The fourth side is not attached to the front cover and forms an overlay pocket opening 49. Preferably, the front and back cover pocket openings are parallel to the hinge 7, providing easier insertion and removal of a sheet of paper.

Figure 9:
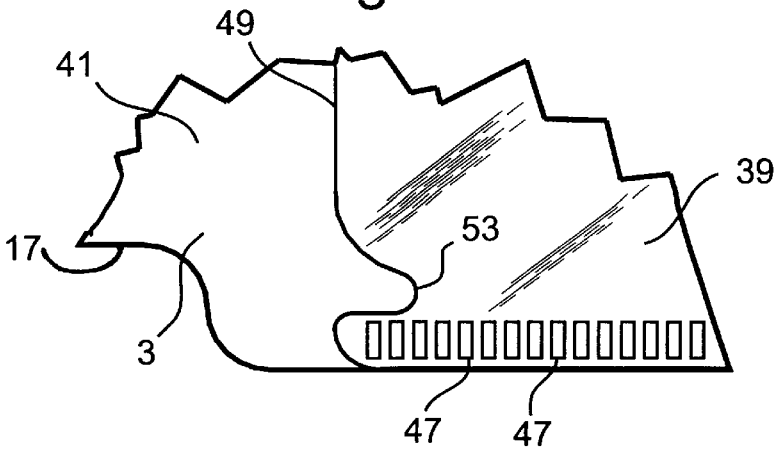
FIG. 9 is an exploded view of the stress relief structure of the overlay pocket.

Since items of varying size and varying amounts of paper may be inserted into the overlay pocket, cutouts 51 are provided in the rectangular sheet of transparent plastic 45 to permit expansion of the pockets. As shown in FIG. 8, preferably two cutouts 51 are provided. The cutouts 51 are preferably circular in shape and disposed at the intersection of the three sides that are attached to the front and back covers. In order to prevent the sheet of material 45 and hence the front and back cover pockets from tearing upon repeated insertion and removal of items, a stress relief structure 53 is provided on either end of the overlay pocket opening 49. As is best shown in FIG. 9, the stress relief structure 53 is generally curved in shaped and has varying radii of curvatures. The stress relief structure 53 permits the opening 49 to flex to accommodate the insertion of items into the pocket while leaving the pocket welds 47 unaffected.

One of ordinary skill in the art can envision numerous variations and modifications of the portfolio of the present invention. For example, multiple overlay pockets can be provided on both the front and back exterior covers and windowed pockets can be used for one or all of the cover and overlay pockets. All of these modifications are contemplated by the true spirit and scope of the following claims.

What is claimed is:

1. A portfolio comprising:

a) a front cover;

b) a back cover pivotally connected to the front cover along a hinge;

c) at least one front cover pocket disposed on an interior surface of the front cover;

d) at least one back cover pocket disposed on an interior surface of the back cover;

e) at least one overlay pocket disposed on an exterior service of one of the front or back covers;

f) a plurality of front cover holes disposed in the front cover adjacent the hinge and arranged to accommodate binder fastener patterns;

g) a plurality of back cover holes disposed in the back cover and arranged to correspond to the front cover holes when the front and back covers are pivoted about the hinge into a closed position; and h) a plurality of slits in the front and back covers running from the hinge to each of the plurality of front and back cover holes to permit insertion and removal of the portfolio from a binder without opening the binder fasteners.

2. The portfolio of claim 1 wherein the front and back covers are formed from a single sheet of material and the hinge is a scored line in the single sheet of material.

3. The portfolio of claim 2, wherein the single sheet of material is translucent.

4. The portfolio of claim 1, wherein:

a) the front cover pocket is formed from a first sheet of rectangular material secured to the front cover along three sides;

b) the back cover pocket is formed from a second sheet of rectangular material secured to the back cover along three sides; and c) the unattached sides of the first and second sheets define a front cover pocket opening and a back cover pocket opening respectively, wherein the front and back cover openings are parallel to the hinge.

5. The portfolio of claim 4, wherein the first and second sheets of material cover only a portion of the interior of the front and back covers respectively.

6. The portfolio of claim 4, wherein the first and second sheets are transparent.

7. The portfolio of claim 4, wherein the first and second sheets further comprise a plurality of cutouts to permit the pocket to expand.

8. The portfolio of claim 7, wherein the cutouts are circular and are disposed at the intersections of the three attached sides.

9. The portfolio of claim 8, further comprising:

a) a notch disposed on either end of the hinge that is sized to accommodate a binder ring mechanism; and b) a stress relief structure on either end of the front and back cover pocket openings to prevent tearing of the first and second sheets upon insertion and removal of objects into and out of the front and back cover pockets.

10. The portfolio of claim 1, wherein the overlay pocket is formed from a rectangular sheet of transparent material attached to the front or rear covers along three sides, the overlay pocket comprising an overlay pocket opening parallel to the hinge.

11. The portfolio of claim 10, further comprising a stress relief structure on either end of the overlay pocket opening to prevent tearing upon insertion and removal of objects into and out of the overlay pocket.

12. A portfolio comprising:

a) a front cover;

b) a back cover pivotally connected to the front cover along a hinge;

c) at least one front cover pocket disposed on an interior surface of the front cover having a front cover pocket opening parallel to the hinge;

d) at least one back cover pocket disposed on an interior surface of the back cover having a back cover pocket opening parallel to the hinge;

e) at least one overlay pocket disposed on an exterior service of one of the front or back covers;

f) a notch disposed on either end of the hinge sized to accommodate a binder ring mechanism; and g) a stress relief structure locate on either end of the front and back cover pocket openings to prevent tearing of the front and back cover pocket openings upon insertion and removal of objects into the front and back cover pockets.

13. The portfolio of claim 12, further comprising:

a) a plurality of front cover holes disposed in the front cover adjacent the hinge and arranged to accommodate binder fastener patterns;

b) a plurality of back cover holes disposed in the back cover and arranged to correspond to the front cover holes when the front and back covers are pivoted about the hinge into a closed position; and c) a plurality of slits in the front and back covers running from the hinge to each of the plurality of front and back cover holes to permit insertion and removal of the portfolio from a binder without opening the binder fasteners.

14. The portfolio of claim 13, wherein the front and back covers are formed from a single translucent sheet of material and the hinge is a scored line in the single sheet of material.

15. The portfolio of claim 14, wherein:

a) the front cover pocket is formed from a first transparent sheet of rectangular material secured to the front cover along three sides;

b) the back cover pocket is formed from a second transparent sheet of rectangular material secured to the back cover along three sides; and c) the unattached sides of the first and second sheets define the front and back cover pocket openings respectively.

16. The portfolio of claim 15, further comprising a plurality of circular cutouts disposed at the intersections of the three attached sides to permit the pocket to expand.

17. The portfolio of claim 16, wherein the first and second sheets of material cover only a portion of the interior of the front and back covers respectively.

18. The portfolio of claim 17, wherein the overlay pocket is formed from a third rectangular transparent sheet of material attached to either the front or rear cover along three sides and comprising an overlay pocket opening parallel to the hinge.

19. The portfolio of claim 18, further comprising a stress relief structure on either end of the overlay pocket opening to prevent tearing of the overlay material upon insertion and removal of objects into and out of the overlay pocket.

20. A portfolio comprising:

a) a front cover;

b) a back cover pivotally connected to the front cover along a hinge;

c) at least one front cover pocket disposed on an interior surface of the front cover;

d) at least one back cover pocket disposed on an interior surface of the back cover;

e) a plurality of front cover holes disposed in the front cover adjacent the hinge and arranged to accommodate binder fastener patterns;

f) a plurality of back cover holes disposed in the back cover and arranged to correspond to the front cover holes when the front and back covers are pivoted about the hinge into a closed position;

g) a plurality of slits in the front and back covers running from the hinge to each of the plurality of front and back cover holes to permit insertion and removal of the portfolio from a binder without opening the binder fasteners; and h) a stress relief structure locate on either end of the front and back cover pocket openings to prevent tearing of the front and back cover pocket openings upon insertion and removal of objects into the front and back cover pockets.

* * * * *